US006205903B1

(12) United States Patent
Woodall et al.

(10) Patent No.: US 6,205,903 B1
(45) Date of Patent: Mar. 27, 2001

(54) RELIABLE AND EFFECTIVE LINE CHARGE SYSTEM

(75) Inventors: Robert Woodall, Lynn Haven; Felipe Garcia, Panama City; Gilberto Irizarry, Panama City Beach, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/012,932

(22) Filed: Jan. 24, 1998

Related U.S. Application Data

(63) Continuation-in-part of application No. 08/944,049, filed on Sep. 12, 1997, now Pat. No. 5,932,835.

(51) Int. Cl.[7] ..... B64D 1/04
(52) U.S. Cl. ..... 89/1.13; 89/1.34; 102/403
(58) Field of Search ..... 89/1.13, 1.34, 89/1.11; 102/402, 403

(56) References Cited

U.S. PATENT DOCUMENTS

| | | | | |
|---|---|---|---|---|
| 981,677 | * | 1/1911 | Pain | 102/360 |
| 3,114,316 | * | 12/1963 | Littleton | 89/1.13 |
| 3,242,862 | * | 3/1966 | Stegbeck et al. | 89/1.13 |
| 4,313,380 | * | 2/1982 | Martner et al. | 181/116 |
| 5,167,382 | * | 12/1992 | Rochester et al. | 244/3.12 |
| 5,174,384 | * | 12/1992 | Herman | 169/70 |
| 5,524,524 | * | 6/1996 | Richards et al. | 89/1.13 |
| 5,675,104 | * | 10/1997 | Schorr et al. | 89/1.13 |

* cited by examiner

*Primary Examiner*—Charles T. Jordan
*Assistant Examiner*—Michelle Thomson
(74) *Attorney, Agent, or Firm*—Harvey A. Gilbert; Donald G. Peck

(57) ABSTRACT

A line charge has a series of spaced-apart warheads coupled to strength members and a detonating cord freely extends through bores in the warheads. A rocket motor at one end of the strength members pulls the line charge across an obstacle laden area. An anchored tether or drogue chute at the other end arrests flight of the line charge and it drops across the area. The thermoplastic, polymeric, or metallic strength members provide strain management to withstand the severe deployment forces and to preclude damage to the detonating cord. Strain is absorbed by the elastic deformation of the strength members coupled to the warheads. Strain also is reduced through direct dissipation of energy by dynamic frictional losses created between strength members, coupling components, and anchoring devices during deployment when slippage occurs between the strength members and coupling components and anchoring devices. Strain reduction occurs when the strength members are made from viscoelastic polymeric materials that are elastically and plastically deformed during deployment. Such materials have characteristics of both elastic solids and viscous fluids and yield both recoverable (time-delayed) and non-recoverable displacements. Routing, but not attaching, the detonating cord through the warheads reduces loading on the detonating cord to negligible levels. Consequently, the light-weight line charge is reliably deployed for effective clearing operations.

15 Claims, 1 Drawing Sheet

RELIABLE AND EFFECTIVE LINE CHARGE SYSTEM

CROSS REFERENCE TO RELATED APPLICATION

This is a continuation in part of U.S. patent application entitled "Line Charge Insensitive Munition Warhead" by Felipe Garcia et al., U.S. Patent and Trademark Office Ser. No. 08/944,049 (NC 78,448), now U.S. Pat. No. 5,932,835 filed Sep. 12, 1997 and incorporates all references and information thereof by reference herein.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to deployable munitions. In particular, this invention relates to a line charge of warheads for clearing mines and obstacles that includes novel structure to withstand severe deployment forces and to prevent damage to detonation components thereby assuring reliable and effective deployment of the warheads.

Anti-personnel obstacles and mines have been cleared from narrow passageways or lanes using a number of different explosive devices. One well-known device is the Bangalore Torpedo. The Bangalore Torpedo is not without its disadvantages, however. Generally speaking, although it is claimed to be portable, it is heavy and bulky. For example, to clear a 45-meter path, the users must handle a 530-pound weapon system. But, a further consequence of using the Bangalore Torpedo is that it exposes several members of the firing team to enemy fire for extended periods as it is being emplaced. Another line charge system currently in inventory is not even man-portable since it will weigh more than 2500 pounds. Still other demolition systems are available, but they too, for one reason or another, are inadequate or unacceptable for many breaching operations. In particular, many contemporary systems for breaching obstacles with explosives have a tendency to tear-apart or malfunction during deployment, to be inadequate for thorough demolitions, and to create elevated risks of explosive mishaps to undesirable and unacceptable levels.

Thus, in accordance with this inventive concept, a need has been recognized in the state of the art for a lightweight and readily deployable line charge that is reliably deployed to clear a lane through antipersonnel mines and wire obstacles for assault breaching operations.

SUMMARY OF THE INVENTION

The present invention is directed to providing a line charge having a plurality of elongated strength members. A plurality of warheads is spaced-apart along the length of the strength members and each has a traverse bore. A plurality of coupling components couples the warheads to the strength members and a detonating element extends through the bores. The detonating element is sized for longitudinal displacement in the bores and is unattached to the warheads.

An object of the invention is to provide a line charge for clearing a lane through mines and obstacles.

Another object of the invention is to provide a lightweight line charge that is reliably deployed and is capable of clearing a lane through antipersonnel mines and wire obstacles.

Another object of the invention is to provide a line charge securely positioning a plurality of warheads for selective demolitions.

Another object of the invention is to provide a relatively lightweight line charge.

Another object of the invention is to provide a line charge having warheads that are not secured to its detonating cord to assure effective detonation.

Another object of the invention is to provide a line charge using warheads each provided with an axial bore sized to allow displacement of detonating cord that runs through it to the next warhead.

Another object of the invention is to provide a reliably deployed line charge securing a series of explosive charges, or warheads, to several flexible strength members and freely passing detonating cord through bores in the warheads.

Another object of the invention is to absorb strain created during deployment of a line charge by elastic deformation of thermoplastic, polymeric, or metallic strength members secured directly to the warheads.

Another object of the invention is to dissipate dynamic frictional losses between strength members and coupling components to reduce strains created during deployment of the line charge when slippage occurs between the strength members and the coupling components.

Another object of the invention is to dissipate dynamic frictional losses between strength members and frictionally engaging means to reduce strains created during deployment of the line charge when slippage occurs between the strength members and the frictionally engaging means.

Another object of the invention is to dissipate dynamic frictional losses between a tether and frictionally engaging means of anchoring devices to reduce strains created during deployment of the line charge when slippage occurs between the tether and the frictionally engaging means.

Another object of the invention is to provide a line charge having strength members selected from viscoelastic polymeric materials for elastically and plastically deforming to reduce strains created during deployment of the line charge.

Another object of the invention is to provide a line charge having strength members selected from viscoelastic polymeric materials that are non-Newtonian materials that exhibit characteristics of both elastic solids and viscous fluids, resulting in both recoverable (time-delayed) and nonrecoverable displacements.

Another object of the invention is to provide cost-effective and uncomplicated line charges that secure warheads at constant or variable separations from one another on thermoplastic, polymeric, or metallic strength members to withstand severe deployment forces and to prevent damage to detonating cords or similar electric or nonelectric devices used for detonation of the explosive charges.

Another object of the invention is to provide a line charge that emplaces weapons over land or in water for applications in surface and subsurface warfare.

These and other objects of the invention will become more readily apparent from the ensuing specification when taken in conjunction with the appended claims.

DESCRIPTION OF THE PREFERRED EMBODIMENTS

Figure 1:
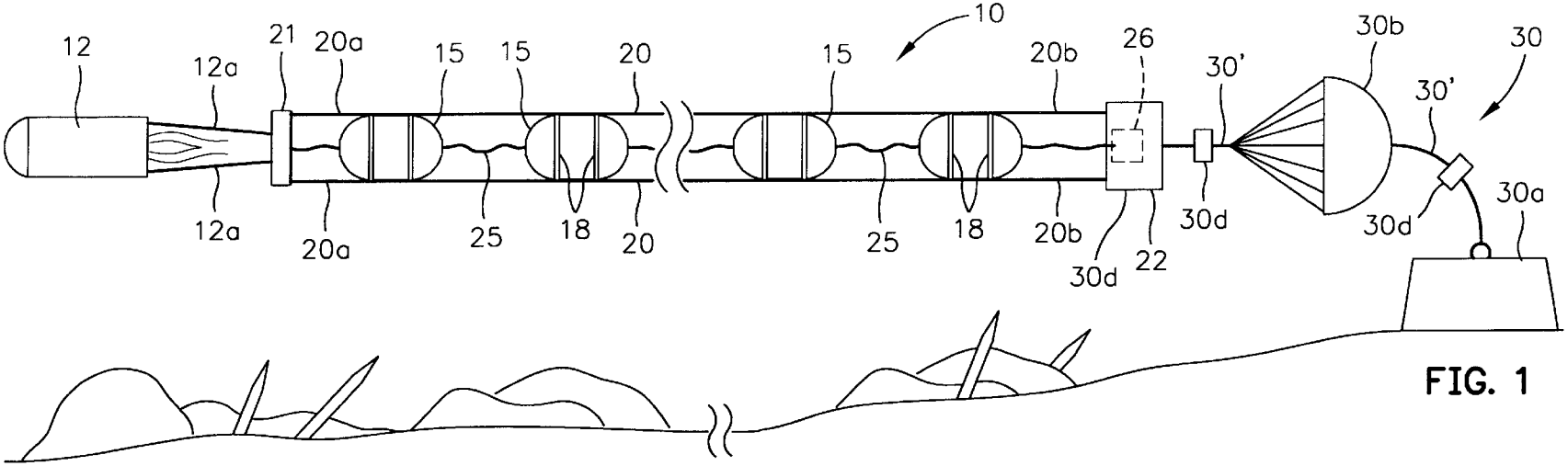
FIG. 1 is a side view of a schematic representation of a line charge having a plurality of warheads being deployed across obstacles and mines to clear a safe lane in accordance with this invention.
Figure 2:
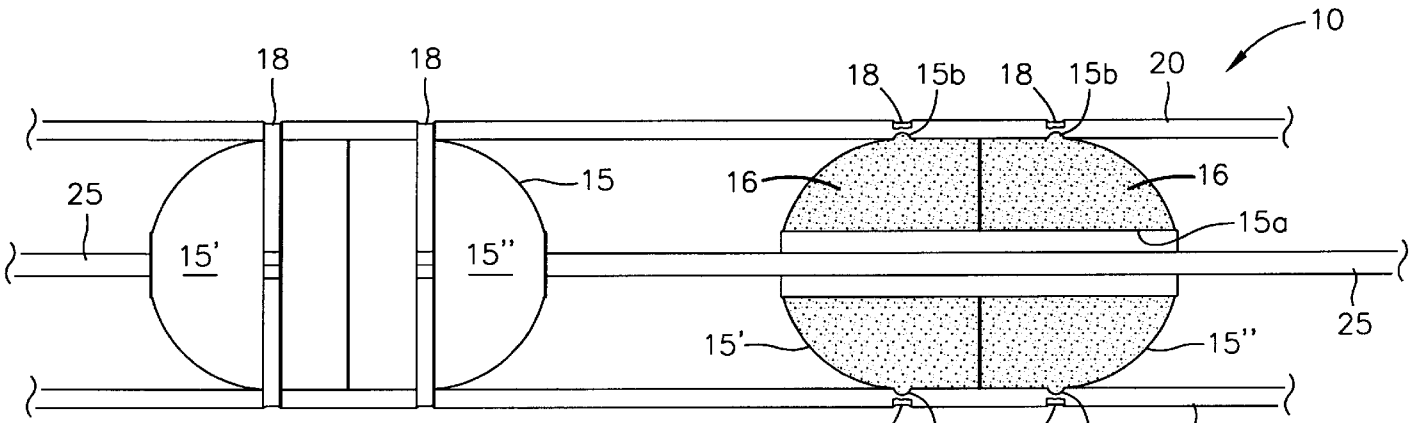
FIG. 2 is a partial cross-sectional side view of warheads in a portion of the line charge of FIG. 1 showing detonating cord freely passing through the axial bores and the securing members secured to the shells of a warhead.

Referring to FIGS. 1 and 2 of the drawings, line charge 10 is schematically depicted being deployed over an area laden with obstacles that block or interfere with free passage through it. Line charge 10 includes a plurality of explosive charges or warheads 15. Only a few warheads 15 are shown; it is understood that many could extend in a series to clear a long path if needed. Each warhead 15 includes a case that is secured by coupling components 18, in a manner to be elaborated on below, to several strength members 20 that extend the length of line charge 10. Warheads 15 are spaced-apart in a series or line of such explosive charges; hence, this arrangement is commonly called a line charge.

Noting FIG. 2, detonating element 25, such as a detonating cord, extends through bore 15*a* provided in each warhead 15. Sufficient slack is provided for in detonating cord 25 to help it withstand the rigors associated with deployment of line charge 10. When a remote detonator 26 on framework 22, for example, is attached to detonator cord 25 and is initiated, detonating cord 25 detonates all warheads 15, virtually simultaneously. The relative sizes of bores 15*a* and detonating cord 25 are such as to allow free longitudinal displacement of detonating cord 25 through bores 15*a*. Detonating cord 25 is not connected to any warhead 15.

For successful clearing of a path, or lane through the area, line charge 10 is placed to lie across the area and is detonated. A preferred method of emplacing line charge 10 relies on coupling rocket motor 12 via lines 12*a* to bridle 21. Bridle 21 is connected to first ends, the distal ends 20*a*, of strength members 20 and to one end of detonating cord 25. The other ends, or near ends 20*b*, of strength members 20 and detonating element 25 are coupled to rings on framework 22 that are connected to an anchoring device 30 via tether 30'.

Anchoring device 30 may be a fixed anchoring point 30*a* at the near side of the area, a means for aerodynamically attenuating forward motion such as a drogue chute 30*b*, or a combination of the two, for example. In this regard, any of these parts of anchoring device 30 may include suitable means 30*d* for frictionally engaging a length of tether 30'. In addition to frictionally engaging means 30*d* provided as schematically depicted in FIG. 1, frictionally engaging means 30*d* may also be included as part of framework 22, anchoring point 30*a* and/or drogue chute 30*b* to engage a length of tether 30'. Frictionally engaging means 30*d* as part of framework 22 would be some pretensioned clamping arrangement, for example, that engages lengths of strength members 20 and allows a predetermined slippage of strength members 20 to absorb shock. Irrespective of where the exact location of frictionally engaging means 30*d* is, it is adjusted to so that either strength members 20 and/or tether 30' may slip a predetermined amount during deployment when predetermined forces are exceeded. This helps dissipate some of the violent forces and strains created during the phases of deployment of line charge 10.

Rocket motor 12 is aimed across the obstructed area. When it is fired, it accelerates rapidly and pulls line charge 10 along with it across the area during this launch phase of deployment. Anchoring device 30 may stop line charge 10 rather violently as it decelerates line charge 10 from going further and line charge 10 falls to the ground during this phase of deployment. During the launch phase and the deceleration stage, frictionally engaging means 30*d* of anchoring device 30 permits predetermined amounts of slippage of lengths of strength members 20 and/or tether 30' to help dissipate some of the violent forces and strains created during both these phases.

Detonation of line charge 10 causes the obstacles, such as wire entanglements and mines, for example, to be broken-up, blown out of the way, and/or detonated to define a cleared lane across the area for free passage.

The clearing capability of line charge 10 is directly dependent on the effectiveness and reliability of warheads 15. However, the amount, size, and spacing of warheads 15 are not the only important considerations for clearing effectiveness; the design of line charge 10 as disclosed herein also assures effective and reliable detonation of warheads 15 after they have settled. In other words, differently sized warheads 15 or different numbers of such warheads 15 can be selected with different spacings as needed for different clearing operations, but the invention herein disclosed assures reliable deployment of the different configurations.

Referring to FIG. 2, warheads 15 are explosive-filled shells, or cases, 15' and 15" filled with explosive 16 and secured together. They are fabricated to survive the rigors associated with handling and deploying line charges with rocket motors. An axially extending bore 15*a* in each warhead 15 extends through the explosive and the shells and is sized to be larger than any part of detonating cord 25. Detonating cord 25 is free to longitudinally slide through each and all of warheads 15. See the above cross-referenced pending patent application for details of a typical warhead suitable for inclusion in line charge 10.

Furthermore, as pointed out in the referenced application each warhead 15 has several dimples, or protuberances, 15*b* equidistantly spaced, or otherwise appropriately located on the outside surfaces of their shell-like cases. These dimples 15*b* function to be engaged by strength members 20 and coupling components 18 so that warheads 15 are suitably connected to strength members 20. Coupling components 18 may be metal straps tightened and/or otherwise secured to couple each warhead 15 to strength members 20. Any of many acceptable coupling means may be selected as coupling components 18 to join warheads 15 to the strength members 20, as described below.

In the representative embodiment set out herein, warheads 15 are tangentially contacted by a pair of strength members 20 that extend along opposite sides of warheads 15. This contact is made along circumferentially, equidistantly-spaced locations on the outer surfaces of the shells of warheads 15. This spacing of strength members 20 on warheads 15 tends to equally transfer deployment forces to warheads 15 and reduces the possibility of generating further destabilizing forces along line charge 10. It is to be understood that more equidistantly-spaced strength members 20 could be used and/or more or fewer coupling components 18 could be used as needed to mount warheads 15 in other line charges for different clearing operations. However, irrespective how many of these components are selected, care must be taken not to interfere with or otherwise prevent free longitudinal travel of detonating cord 25 in line charge 10. It should be reemphasized at this time that the manner of coupling of warheads 15 to strength members 20, the constituencies of the components and their arrangements as disclosed herein all contribute to the novel features of this invention. These novel features assure more reliable and effective deployment of line charge 10 to accomplish the mission.

In accordance with this invention line charge 10 assures that the forces and strains created during its deployment are at least partially absorbed by (1) the elastic deformation of thermoplastic, polymeric, or metallic strength members 20 coupled to warheads 15 by coupling components 18. Also, if needed, line charge 10 reduces forces and strains by (2) dissipating energy through dynamic frictional losses effected among thermoplastic, polymeric, or metallic strength members 20, coupling components 18, the cases of warheads 15, and frictionally engaging means 30*d* of framework 22 and anchoring device 30. The dynamic frictional losses come into play when the holding forces exerted by coupling components 18 and the frictionally engaging means 30*d* of framework 22 and anchoring device 30 are exceeded during deployment, and strength members 20 and tether 30' slip. Finally, and in addition to the elastic and frictional strain dissipation mechanisms (1) and (2), set forth above, the design of line charge 10 provides for additional strain reduction through (3) the combination of elastic and plastic deformations of viscoelastic polymeric materials used as strength members 20. Viscoelastic polymeric materials are non-Newtonian materials that exhibit characteristics of both elastic solids and viscous fluids, resulting in both recoverable (time-delayed) and nonrecoverable displacements of strength members 20. In the context of this invention, the term non-Newtonian means that the materials stretch and deform and do not follow the normal, classic definitions and conventional laws of energy, force, and momentum as set out in Newton's laws.

Typical thermoplastic, polymeric, or metallic strength members are polyethelene, polyvinylchloride, etc.; nylon, rayon, etc.; and cables, straps, and bands of steel, aluminum, etc., respectively. Typical viscoelastic polymeric materials are sorbothane, neoprene, etc. Having this invention in mind, one skilled in the art can select from these and from many other suitable materials to fashion strength members that will function as necessary to assure reliable deployment.

Another significant feature of this invention is that failure-inducing forces are removed from reaching detonating cord 25. Fishing a fabric reinforced and explosively filled detonating cord 25 through warheads 15 and strength members 20 reduces deployment loads on detonating cord 25 to negligible levels. Within the force-elongation limits of the thermoplastic, polymeric, or metallic strength members 20, detonating cord 25 performs as intended while not substantially interfering with the desired distances between warheads 15.

Parts of line charge 10 can be implemented in various ways. Detonating cord 25 can be another detonating element other than the detonating cord described above. Electric detonators with their cables can be substituted to benefit from this design to preclude damage from the deployment forces. Likewise, other types of nonelectric detonating trains can be used. Sufficient slack in the cables and trains will be given throughout line charge 10 and none will be connected to warheads 15.

The sizes and types of the explosive charges in warheads 15 are dictated by the intended target with consideration given to fragmentation, blast, incendiary, concussion, or combinations of these capabilities. The spacing between the explosive charges can vary. The selected spacing can produce a line charge where all the explosive charges abut or a line charge where the explosive charges are spaced. The warheads can be fabricated to meet insensitive munitions requirements, if desired.

The mechanical holding/anchoring structure of coupling components 18 and the frictionally engaging means of anchoring device 30 can be diverse: clamps, pins, bolts, rivets, rollers, cleats, etc. The frictional engagement of moving surfaces of strength members 20 in combination with the surfaces of cases for warheads 15, surfaces of coupling components 18, and the surfaces of frictionally engaging means 30*d* of framework 22 and anchoring device 30 dissipate energy through dynamic frictional losses. Strength member 20 can also be diverse: ropes, cables, hoses, polymeric tubes, etc. Because polymeric materials can show vastly different properties depending on the rate of load transfer, diverse ranges of materials exist that can exhibit characteristics of both elastic solids and viscous fluids, resulting in both recoverable (time-delayed) and nonrecoverable displacements and as a result different levels of strain absorption. The management of detonation transfer element 25 or the ancillary elements of these devices can be effected in several ways: looping or coiling with stowage within strength member 20, or looping or coiling within frangible enclosures placed between warheads 15, or looping or coiling bare and placed between warheads 15.

The implementation of this invention can be diverse. One or a combination of the three aforementioned mechanisms for strain absorption and reduction, or the management of the detonation transfer devices or the management of the ancillary elements of these devices ensures reliable detonation transfer. Such line charge 10 fabricated in accordance with this invention is flown down range over a target area. Usually after a given delay, its warheads 15 are detonated reliably to clear a lane.

Line charge 10 has been described using an exemplary arrangement of components. This arrangement is not to be construed as limiting, but rather is intended for demonstrating this inventive concept. Therefore, it is to be understood that, having the teachings of this invention in mind, one skilled in the art to which this invention pertains can select other combinations of materials and arrangements thereof and still be within the scope of this invention. Similarly, the capabilities of the invention that were disclosed herein were selected for demonstration of some salient features of this invention. They are not to be construed as limiting the applications and scope of this invention.

It should be readily understood that many modifications and variations of the present invention are possible within the purview of the claimed invention. It is therefore to be understood that within the scope of the appended claims the invention may be practiced otherwise than as specifically described.

What is claimed is:

1. A line charge comprising:

a plurality of elongate strength members;

a plurality of warheads each having a longitudinal bore, said warheads being spaced-apart along the length of said plurality of strength members;

a plurality of components coupling said warheads to said strength members; and a detonating element extending through said bores, said detonating element being sized for longitudinal displacement in said bores and unattached to said warheads, said strength members being equidistantly-spaced from one another on said warheads, and said strength members and said coupling components dissipating dynamic frictional losses between said strength members and said coupling components to reduce strains created during deployment of said line charge when slippage occurs between said strength members and said coupling components.

2. An apparatus according to claim 1 in which said strength members are viscoelastic polymeric materials elastically and plastically deforming to reduce strains created during deployment of said line charge.

3. An apparatus according to claim 2 in which said viscoelastic polymeric materials are non-Newtonian materials that exhibit characteristics of both elastic solids and viscous fluids, resulting in both recoverable (time-delayed) and non-recoverable displacements.

4. An apparatus according to claim 1 further including:

means for frictionally engaging said strength members, said strength members and frictionally engaging means dissipate dynamic frictional losses therebetween to reduce strains created during deployment of said line charge when slippage occurs between said strength members and said frictionally engaging means.

5. An apparatus according to claim 1 further including:

a tether coupled to said strength members; and an anchoring device having frictionally engaging means coupled to said tether, said tether and frictionally engaging means dissipate dynamic frictional losses when slippage occurs between said tether and said frictionally engaging means to reduce strains during deployment of said line charge.

6. An apparatus according to claim 5 wherein said anchoring device includes a means for aerodynamically attenuating forward motion of said line charge during deployment.

7. An apparatus according to claim 1 further including:

a tether coupled to said strength members; and an anchoring device having frictionally engaging means coupled to said tether, said tether and frictionally engaging means dissipate dynamic frictional losses when slippage occurs between said tether and said frictionally engaging means to reduce strains during deployment of said line charge.

8. An apparatus according to claim 1 in which said strength members are selected from the group consisting of thermoplastic, polymeric and metallic strength members.

9. A line charge comprising:

a plurality of elongate strength members;

a plurality of warheads each having a longitudinal bore, said warheads being spaced-apart along the length of said plurality of strength members;

a plurality of components coupling said warheads to said strength members; and a detonating element extending through said bores, said detonating element being sized for longitudinal displacement in said bores and unattached to said warheads, said strength members being equidistantly-spaced from one another on said warheads, said strength members elastically deforming to absorb strains created during deployment of said line charge, and said strength members and said coupling components dissipating dynamic frictional losses between said strength members and said coupling components to reduce strains created during deployment of said line charge when slippage occurs between said strength members and said coupling components.

10. An apparatus according to claim 9 in which said strength members are viscoelastic polymeric materials elastically and plastically deforming to reduce strains created during deployment of said line charge.

11. An apparatus according to claim 10 further including:

means for frictionally engaging said strength members, said strength members and frictionally engaging means dissipate dynamic frictional losses therebetween to reduce strains created during deployment of said line charge when slippage occurs between said strength members and said frictionally engaging means.

12. An apparatus according to claim 11 further including:

a tether coupled to said strength members; and an anchoring device having frictionally engaging means coupled to said tether, said tether and frictionally engaging means dissipate dynamic frictional losses when slippage occurs between said tether and said frictionally engaging means to reduce strains during deployment of said line charge.

13. An apparatus according to claim 9 further including:

means for frictionally engaging said strength members, said strength members and frictionally engaging means dissipate dynamic frictional losses therebetween to reduce strains created during deployment of said line charge when slippage occurs between said strength members and said frictionally engaging means.

14. An apparatus according to claim 9 further including:

a tether coupled to said strength members; and an anchoring device having frictionally engaging means coupled to said tether, said tether and frictionally engaging means dissipate dynamic frictional losses when slippage occurs between said tether and said frictionally engaging means to reduce strains during deploymemt of said line charge.

15. An apparatus according to claim 9 in which said strength members are selected from the group consisting of thermoplastic, polymeric and metallic strength members.

* * * * *